US010598171B2

(12) United States Patent
Kimmel

(10) Patent No.: US 10,598,171 B2
(45) Date of Patent: Mar. 24, 2020

(54) MICROFLUIDIC PUMP APPARATUS AND METHODS

(71) Applicant: Nokia Technologies Oy, Espoo (FI)

(72) Inventor: Jyrki Kimmel, Tampere (FI)

(73) Assignee: Nokia Technologies Oy, Espoo (FI)

( * ) Notice: Subject to any disclaimer, the term of this patent is extended or adjusted under 35 U.S.C. 154(b) by 123 days.

(21) Appl. No.: 15/540,795

(22) PCT Filed: Dec. 21, 2015

(86) PCT No.: PCT/FI2015/050913
§ 371 (c)(1),
(2) Date: Jun. 29, 2017

(87) PCT Pub. No.: WO2016/107974
PCT Pub. Date: Jul. 7, 2016

(65) Prior Publication Data

US 2018/0003167 A1 Jan. 4, 2018

(30) Foreign Application Priority Data

Dec. 30, 2014 (EP) ..... 14200556

(51) Int. Cl.
*F04B 43/12* (2006.01)
*F04B 19/00* (2006.01)
(Continued)

(52) U.S. Cl.
CPC ..... *F04B 43/12* (2013.01); *F04B 19/006* (2013.01); *F04B 43/09* (2013.01); *F04B 49/06* (2013.01)

(58) Field of Classification Search
CPC .. F04B 39/10; F04B 39/0027; F04B 39/0055; F04B 39/125; F04B 39/123;
(Continued)

(56) References Cited

U.S. PATENT DOCUMENTS 5,798,600 A 8/1998 Sager et al.
7,397,166 B1 7/2008 Morgan et al.
(Continued)

FOREIGN PATENT DOCUMENTS

CN 1916411 A 2/2007
CN 101124403 A 2/2008
(Continued)

OTHER PUBLICATIONS

Office action received for corresponding Chinese Patent Application No. 201580069679.2, dated Jun. 21, 2018, 7 pages of office action and no pages of office action translation available.
(Continued)

*Primary Examiner* — Devon C Kramer
*Assistant Examiner* — Christopher J Brunjes
(74) *Attorney, Agent, or Firm* — Harrington & Smith

(57) ABSTRACT

An apparatus and method, the apparatus comprising: a microfluidic channel (3); an electromechanical gel (5) provided within the microfluidic channel (3); at least one pair of electrodes (7) wherein the at least one pair of electrodes (7) are configured to control the electric field across the microfluidic channel (3) to cause the electromechanical gel (5) to deform in response to a voltage applied to the electrodes (7) such that the deformation enables fluid to be pumped through the microfluidic channel (3).

15 Claims, 8 Drawing Sheets

(51) Int. Cl.
*F04B 43/09* (2006.01)
*F04B 49/06* (2006.01)

(58) Field of Classification Search
CPC .. F04B 39/122; F04B 39/121; F04B 39/1073; F04B 39/1066; F04B 39/0016; F04B 53/10; F04B 53/148; F04B 35/04; F04B 19/022; F04B 19/22; F04B 7/02; F04B 7/0003; F04B 7/0208; F04B 7/04; F04B 43/12; F04B 43/09; F04B 19/006; F04B 49/06; F04C 28/24; F04C 14/24
See application file for complete search history.

(56) References Cited

U.S. PATENT DOCUMENTS

| | | | | |
|---|---|---|---|---|
| 8,148,159 | B2 | 4/2012 | Randall et al. | |
| 9,583,257 | B2 | 2/2017 | Blomqvist et al. | |
| 2002/0013545 | A1* | 1/2002 | Soltanpour | A61F 9/00781 604/9 |
| 2007/0128059 | A1 | 7/2007 | Bagwell | |
| 2007/0170822 | A1* | 7/2007 | Pei | H01L 41/0536 310/363 |
| 2012/0273702 | A1* | 11/2012 | Culbertson | B01L 3/502707 251/129.01 |

FOREIGN PATENT DOCUMENTS

| | | | |
|---|---|---|---|
| CN | 102897707 | A | 1/2013 |
| DE | 102013009592 | A1 | 12/2014 |
| EP | 1748190 | A1 | 1/2007 |
| JP | H09287571 | A | 11/1997 |
| JP | 2009108769 | A * | 5/2009 |
| JP | 2009108769 | A | 5/2009 |
| WO | 2006065884 | A2 | 6/2006 |
| WO | 2008/010181 | A2 | 1/2008 |
| WO | 2011/102801 | A1 | 8/2011 |
| WO | 2013044195 | A2 | 3/2013 |

OTHER PUBLICATIONS

International Search Report and Written Opinion received for corresponding Patent Cooperation Treaty Application No. PCT/FI2015/050913, dated Apr. 20, 2016, 13 pages.
Tuomikoski, "Fabrication of SU-8 Microstructures for Analytical Microfluidic Applications", Dissertation, Feb. 2007, 66 pages.
Gong et al., "Polydimethylsiloxane-Based Conducting Composites and Their Applications in Microfluidic Chip Fabrication", AIP Biomicrofluidics, vol. 3, No. 1, Mar. 23, 2009, pp. 1-10.
"Silicone", Wikipedia, Retrieved on Jan. 8, 2018, Webpage available at : https://en.wikipedia.org/wiki/Silicone.
Extended European Search Report received for corresponding European Patent Application No. 14200556.0, dated Aug. 7, 2015, 8 pages.
Office action received for corresponding European Patent Application No. 14200556.0, dated Oct. 18, 2017, 4 pages.

* cited by examiner

MICROFLUIDIC PUMP APPARATUS AND METHODS

RELATED APPLICATION

This application was originally filed as Patent Cooperation Treaty Application No. PCT/FI2015/050913, filed Dec. 21, 2015 which claims priority benefit to EP Patent Application No. 14200556.0, filed Dec. 30, 2014.

TECHNOLOGICAL FIELD

Examples of the disclosure relate to microfluidic pump apparatus and methods. In particular, they relate to microfluidic pump apparatus and methods which use an electromechanical gel.

BACKGROUND

Microfluidic pumps which enable small volumes of fluids to be controlled are known. It is useful to be able to manufacture such pumps easily. It may also be useful to enable such pumps to be provided on polymer based substrates. This may enable the pumps to be used for biomechanical assay chips.

BRIEF SUMMARY

According to various, but not necessarily all, examples of the disclosure there may be provided an apparatus comprising: a microfluidic channel; an electromechanical gel provided within the microfluidic channel; at least one pair of electrodes wherein the pair of electrodes is configured to control an electric field across the microfluidic channel; wherein the at least one pair of electrodes are configured to control the electric field across the microfluidic channel to cause the electromechanical gel to deform in response to a voltage applied to the electrodes such that the deformation enables fluid to be pumped through the microfluidic channel.

In some examples the at least one pair of electrodes may be configured to enable the voltage to be provided perpendicular to a direction of fluid flow within the microfluidic channel.

In some examples the at least one pair of electrodes may be configured to provide a voltage across the microfluidic channel.

In some examples the at least one pair of electrodes may be configured to provide a voltage close to the microfluidic channel.

In some examples the apparatus may comprise a plurality of pairs of electrodes. The plurality of pairs of electrodes may extend parallel to a direction of fluid flow within the microfluidic channel. The plurality of pairs of electrodes may be configured to sequentially apply a voltage across the microfluidic channel. The sequentially applied voltages may enable peristaltic pump action through the microfluidic channel.

In some examples the at least one pair of electrodes may be configured so that the electromechanical gel deforms to form a cavity within the microfluidic channel when a voltage is applied to the electrodes.

In some examples the at least one pair of electrodes may be configured so that the electromechanical gel deforms to form a restriction within the microfluidic channel when a voltage is applied to the electrodes.

In some examples the apparatus may further comprise controlling circuitry configured to control the voltages applied by the pairs of electrodes across the microfluidic channel.

In some examples the apparatus may further comprise a substrate overlaying the microfluidic channel. In some examples the apparatus may further comprise a film between the substrate and the electromechanical gel wherein the film has a higher viscosity than the electromechanical gel.

According to various, but not necessarily all, examples of the disclosure there may be provided a method comprising: providing a microfluidic channel; providing an electromechanical gel provided within the microfluidic channel;

providing at least one pair of electrodes wherein the pair of electrodes is configured to control an electric field across the microfluidic channel;

wherein the at least one pair of electrodes are configured to control the electric field across the microfluidic channel to cause the electromechanical gel to deform in response to a voltage applied to the electrodes such that the deformation enables fluid to be pumped through the microfluidic channel.

In some examples the at least one pair of electrodes may be configured to enable the voltage to be provided perpendicular to a direction of fluid flow within the microfluidic channel.

In some examples the at least one pair of electrodes may be configured to provide a voltage across the microfluidic channel.

In some examples the at least one pair of electrodes may be configured to provide a voltage close to the microfluidic channel.

In some examples the method may further comprise providing a plurality of pairs of electrodes. The plurality of pairs of electrodes may extend parallel to a direction of fluid flow within the microfluidic channel. The method may further comprise configuring the plurality of pairs of electrodes to sequentially apply a voltage across the microfluidic channel. In some examples the sequentially applied voltages may enable peristaltic pump action through the microfluidic channel.

In some examples the at least one pair of electrodes may be configured so that the electromechanical gel deforms to form a cavity within the microfluidic channel when a voltage is applied to the electrodes.

In some examples the at least one pair of electrodes may be configured so that the electromechanical gel deforms to form a restriction within the microfluidic channel when a voltage is applied to the electrodes.

In some examples the method may further comprise providing controlling circuitry configured to control the voltages applied by the pairs of electrodes across the microfluidic channel.

In some examples the method may further comprise providing a substrate overlaying the microfluidic channel. In some examples the method may further comprise providing a film between the substrate and the electromechanical gel wherein the film has a higher viscosity than the electromechanical gel.

According to various, but not necessarily all, examples of the disclosure there may be provided an apparatus comprising: processing circuitry; and memory circuitry including computer program code; the memory circuitry and the computer program code configured to, with the processing circuitry, cause the apparatus at least to perform: controlling voltages applied by a plurality of pairs of electrodes wherein the plurality of pairs of electrodes are configured to control an electric field across a microfluidic channel so as to deform an electromechanical gel within the microfluidic channel and enable fluid to be pumped through the microfluidic channel.

In some examples the plurality of pairs of electrodes may extend along a direction of fluid flow through the microfluidic channel.

In some examples the voltages may be controlled sequentially.

In some examples the voltages may enable peristaltic pump action.

According to various, but not necessarily all, examples of the disclosure there may be provided a method comprising: controlling voltages applied by a plurality of pairs of electrodes wherein the plurality of pairs of electrodes are configured to control an electric field across a microfluidic channel so as to deform an electromechanical gel within the microfluidic channel and enable fluid to be pumped through the microfluidic channel.

In some examples the plurality of pairs of electrodes may extend along a direction of fluid flow through the microfluidic channel.

In some examples the voltages may be controlled sequentially.

In some examples the voltages may enable peristaltic pump action.

According to various, but not necessarily all, examples of the disclosure there may be provided a computer program comprising computer program instructions that, when executed by processing circuitry, enable: controlling voltages applied by a plurality of pairs of electrodes wherein the plurality of pairs of electrodes are configured to control an electric field across a microfluidic channel so as to deform an electromechanical gel within the microfluidic channel and enable fluid to be pumped through the microfluidic channel.

According to various, but not necessarily all, examples of the disclosure there may be provided a computer program comprising program instructions for causing a computer to perform methods as described above.

In some examples there may be provided a physical entity embodying the computer program as described above.

In some examples there may be provided an electromagnetic carrier signal carrying the computer program as described above.

According to various, but not necessarily all, example of the disclosure there may be provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1A:
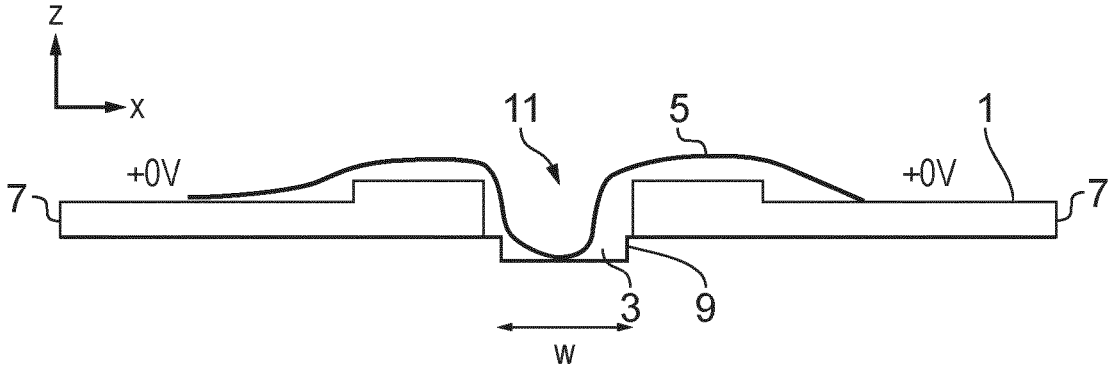
FIGS. 1A and 1B illustrate an apparatus.

The Figures illustrate an apparatus 1 comprising: a microfluidic channel 3; an electromechanical gel 5 provided within the microfluidic channel 3; at least one pair of electrodes 7 wherein the pair of electrodes 7 is configured to control an electric field across the microfluidic channel 3; wherein the at least one pair of electrodes 7 are configured to control the electric field across the microfluidic channel 3 to cause the electromechanical gel 5 to deform in response to a voltage applied to the electrodes 7 such that the deformation enables fluid 21 to be pumped through the microfluidic channel 3.

The apparatus may be a microfluidic pump apparatus for controlling the flow of small volumes of fluid. Examples of the apparatus 1 may be used in biochemical assays, in the manufacture of small devices such as nano-electronic devices or in any other applications which may require small volumes of fluid to be handled. The volumes of fluid which can be handled with such apparatus may be of the order of μL.

Figure 1B:
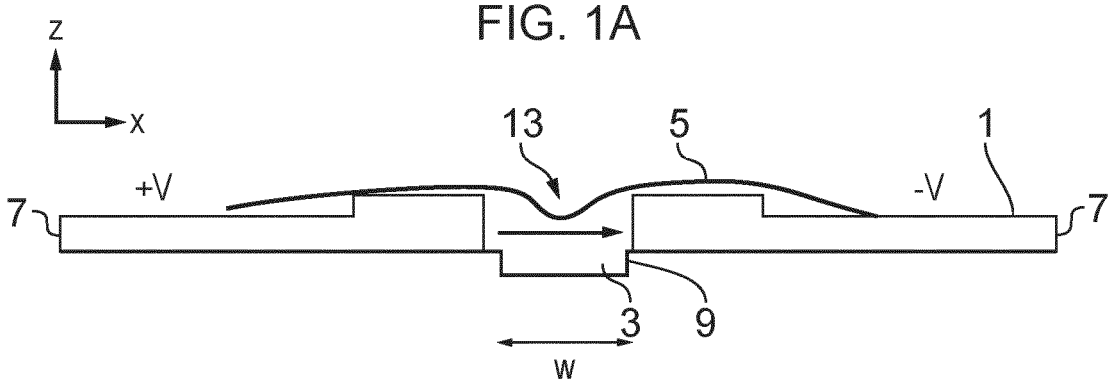

FIGS. 1A and 1B schematically illustrate a cross section through an example apparatus 1. The example apparatus 1 comprises a microfluidic channel 3, an electromechanical gel 5 and at least one pair of electrodes 7.

The same cross section of the apparatus 1 is illustrated in FIGS. 1A and 1B. In the example of FIG. 1A no voltage is applied between the electrodes 7. In the example of FIG. 1B a voltage is applied across the electrodes 7.

The microfluidic channel 3 may comprise means for enabling flow of a small volume of fluid. The microfluidic channel 3 may comprise a path which the fluid can flow along. The microfluidic channel 3 may be any suitable size or shape for providing a flow path for a small volume of fluid.

In the examples of FIGS. 1A and 1B the microfluidic channel 3 comprises a groove in a substrate 9. The substrate 9 may be made of any suitable material such as a polymer, glass, fused silica, silicon or any other material. The groove may be formed using any suitable technique such as chemical etching, printing, deposition or any other suitable technique.

The microfluidic channel 3 has a width W which extends in the x direction as indicated in FIGS. 1A and 1B. The microfluidic channel 3 also has a length which extends in the y direction. In the examples of FIGS. 1A and 1B the y direction extends into the page and so is not illustrated in FIGS. 1A and 1B. The apparatus 1 may be arranged so that fluid can be pumped along the length of the microfluidic channel 3. The length of the microfluidic channel 3 may be larger than the width of the microfluidic channel 3. However, it is to be appreciated that in some examples the apparatus 1 may be designed to have a microfluidic channel 3 with a larger width W than length.

The electromechanical gel 5 may be provided within the microfluidic channel 3. The electromechanical gel 5 may be provided so that at least some of the electromechanical gel 5 is positioned within the microfluidic channel 3. In the examples of FIGS. 1A and 1B some of the electromechanical gel 5 extends out of the microfluidic channel 3. The proportion of the electromechanical gel 5 contained within the microfluidic channel 3 compared to the proportion of the electromechanical gel 5 extending out of the microfluidic channel 3 may be controlled by the voltage applied by the electrodes 7.

The electromechanical gel 5 may comprise any material which may deform or otherwise change shape when a voltage is applied across the electromechanical gel 5. The electromechanical gel 5 may comprise any material which may deform when an electric field is applied to the material. In some examples of the disclosure the electromechanical gel 5 may comprise polysiloxane. It is to be appreciated that any other suitable material may be used in other examples of the disclosure.

In some examples the material which is used as the electromechanical gel 5 may be biocompatible. This may be useful in biochemical assay chips or other similar devices.

In some examples the hydrophobicity of the material which is used as the electromechanical gel 5 may be controlled. In some examples the hydrophobicity of the material which is used as the electromechanical gel 5 may be reduced or minimized to enable the electromechanical gel 5 to increase the area of the substrate 9 which is covered by the electromechanical gel 5 and to reduce the contact angle between the electromechanical gel 5 and the substrate 9.

The electromechanical gel 5 may be applied to the apparatus 1 using any suitable means. For instance the electromechanical gel 5 may be applied to the substrate 9 by depositing the electromechanical gel 5 by spin coating, by using a squeegee or by dipping the substrate 9 in an electromechanical gel 5 or by any other suitable means.

The pair of electrodes 7 may comprise any means which may enable control of an electric field provided across the microfluidic channel 3. In the example of FIGS. 1A and 1B the at least one pair of electrodes 7 are configured to provide a voltage across the microfluidic channel 3. The electrodes 7 may be arranged so that the voltage may be provided perpendicular, or substantially perpendicular, to the direction of fluid flow through the microfluidic channel 3.

In the examples of FIGS. 1A and 1B the pair of electrodes 7 are arranged so that a first electrode 7 is provided on one side of the microfluidic channel 3 and the second electrode 7 is provide on the opposite side of the microfluidic channel 3. The apparatus 1 may be arranged so that the microfluidic channel 3 is provided between the electrodes 7. The electrodes 7 may be arranged so that there is only a small separation between the electrodes 7 within the pair of electrodes. In some examples the distance between the two electrodes 7 within the pair may be 10 μm or approximately 10 μm or smaller. It is to be appreciated that other arrangements of electrodes may be used in other examples of the disclosure.

The electrodes 7 may be made from any suitable material. For instance the electrodes 7 may be formed from a conductive material such as copper, gold, Indium Tin Oxide or any other suitable material. The electrodes may be printed on the substrate 9.

In the example of FIG. 1A there is no voltage applied between the electrodes 7. In FIG. 1A there is no applied electric field in the electromechanical gel 5. The electromechanical gel 5 is arranged in a first configuration in which only a small proportion of the electromechanical gel 5 is positioned within the microfluidic channel 3. The layer of the electromechanical gel 5 provided within the microfluidic channel 3 is thin so that within the microfluidic channel 3 the upper surface of the electromechanical gel 5 may be close to the surface of the microfluidic channel 3.

As only a small portion of the electromechanical gel 5 is provided within the microfluidic channel 3 this provides a cavity 11 within the microfluidic channel 3. The cavity 11 may enable fluid to be positioned within the microfluidic channel 3 and may enable fluid flow along the length of the microfluidic channel 3.

In the example of FIG. 1B a voltage is applied between the electrodes 7. In FIG. 1B there is now an applied electric field in the electromechanical gel 5. The applied electric field causes a change in shape of the electromechanical gel 5.

In FIG. 1B the electromechanical gel 5 is now arranged in a second configuration in which a larger proportion of the electromechanical gel 5 is positioned within the microfluidic channel 3. The proportion of the electromechanical gel 5 positioned within the microfluidic channel 3 increases when the electric field is applied. The layer of the electromechanical gel 5 provided within the microfluidic channel 3 in the second configuration is thicker than the layer provided in the first configuration. In the second configuration the upper surface of the electromechanical gel 5 is separated from the surface of the microfluidic channel 3.

As a larger portion of the electromechanical gel 5 is provided within the microfluidic channel 3 this provides a restriction 13 within the microfluidic channel 3. The restriction 13 may restrict the fluid which can be positioned within the microfluidic channel 3 and reduce and/or prevent fluid flow along the length of the microfluidic channel 3.

Figure 2:
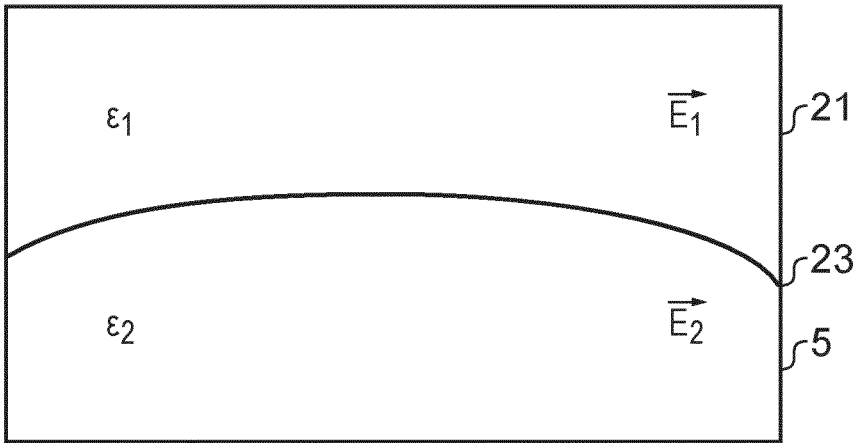
FIG. 2 illustrates electromechanical gel principle.

FIG. 2 illustrates the electromechanical gel principle which demonstrates how an elastic interface between two materials of different electrical permittivities will deform in the presence of an electric field. This principle may be used to control the shape of the electromechanical gel 5 by controlling the voltage across the microfluidic channel.

In the example of FIG. 2 a first material and a second material are illustrated. The first material may be provided overlaying the second material. The first material is provided directly overlaying the second material so that an interface 23 between the first material and the second material is provided. The first material and the second material have different electrical permittivities.

In examples of the disclosure the second material may be the electromechanical gel 5. This may have an electrical permittivity of $£_2$ and an electric field within the electromechanical gel 5 of $E_2$.

The first material may be the fluid 21 which is to be pumped through the microfluidic channel 3. The second material could be any suitable fluid 21 such as water, methanol, ethanol, glycol, acetone, glycerol, nitrobenzene or any other suitable material.

The fluid 21 has an electrical permittivity of $£_1$ and an electric field within the material 21 of $E_1$.

As the electromechanical gel 5 and the fluid 21 have different electrical permittivities this causes a force to be applied to the interface 23 of the electromechanical gel 5 and the fluid 21 when an electrical field if applied. The force is dependent upon the difference in the electrical permittivities of the electromechanical gel 5 and the fluid 5. The force may be given by the equation $$\vec{F} \propto (\varepsilon_2 - \varepsilon_1) \times |\vec{E_1}|^2.$$

As the electromechanical gel 5 and the fluid 21 are deformable the force F causes deformation of the interface 23 between them. This means that when an electric field is applied to the electromechanical gel 5 and the fluid 21 they will change shape. This principle may be used to create a cavity 11 or restriction 13 within the microfluidic channel 3 as illustrated in FIGS. 1A and 1B.

Figure 3:
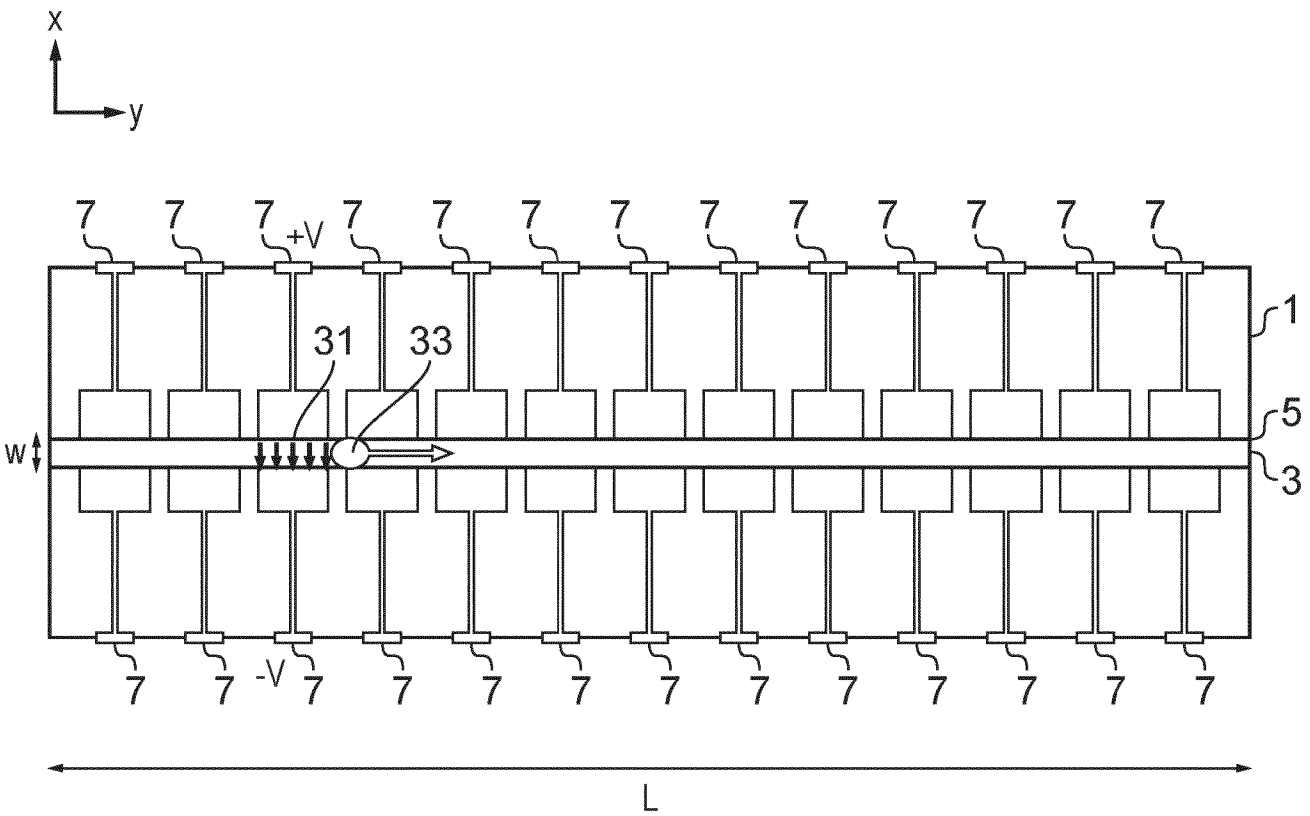
FIG. 3 illustrates an apparatus.

FIG. 3 schematically illustrates a plan view of an apparatus 1 according to examples of the disclosure. The apparatus 1 of FIG. 3 comprises a microfluidic channel 3 and an electromechanical gel 5 as described above in relation to FIGS. 1A to 2.

The example apparatus 1 of FIG. 3 comprises a plurality of pairs of electrodes 7. The electrodes 7 may be as described above in relation to FIGS. 1A to 2. Each pair of electrodes 7 comprises a first electrode 7 provided on a first side of the microfluidic channel 3 and a second electrode 7 provided on the other side of the microfluidic channel 3. Each of the plurality of pairs of electrodes 7 may be arranged to control the electric field across the microfluidic channel 3. In the example apparatus 1 of FIG. 3 Each of the plurality of pairs of electrodes 7 may be arranged to provide a voltage across the microfluidic channel 3. Each of the plurality of pairs of electrodes 7 may be arranged to provide a voltage across the width W of the microfluidic channel 3 so that the voltage is provided perpendicular to the direction of fluid flow through the microfluidic channel 3.

The plurality of pairs of electrodes 7 extend along the length L of the microfluidic channel 3. The length L of the microfluidic channel 3 may extend in a direction perpendicular or substantially perpendicular to the width W of the microfluidic channel 3. The pairs of electrodes 7 may extend along the direction of flow of fluid 21 within the microfluidic channel 3. In the example of FIG. 3 the pairs of electrodes 7 extend in the y direction. The arrows 31 indicate the electric field which can result from applying a voltage across a pair of electrodes 7. The arrow 33 indicates the direction of fluid 21 flow.

The plurality of pairs of electrodes 7 may be configured to enable different voltages to be applied at different positions along the length of the microfluidic channel 3. The electrodes 7 may be controlled independently of each other so that each pair of electrodes 7 can provide a different voltage to other pairs of electrodes 7. This enables different electric field strengths to be provided at different positions along the microfluidic channel 3. This allows for cavities 11 and restrictions 13 to be provided at different points along the length of the microfluidic channel 3.

The electrodes 7 may be controlled to sequentially apply a time varying voltage. This can be used to change the positions of cavities 11 and restrictions 13 within the microfluidic channel 3. This may enable fluid 21 to be pumped along the length of the microfluidic channel 3. In some examples the electrodes 7 may be controlled to enable fluid 21 to be pumped through the microfluidic channel 3 using a peristaltic action.

Figure 5A:
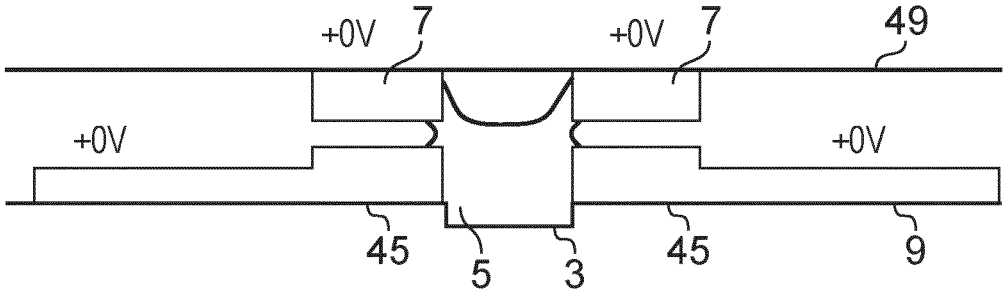
FIGS. 5A and 5B illustrate an apparatus.
Figure 5B:
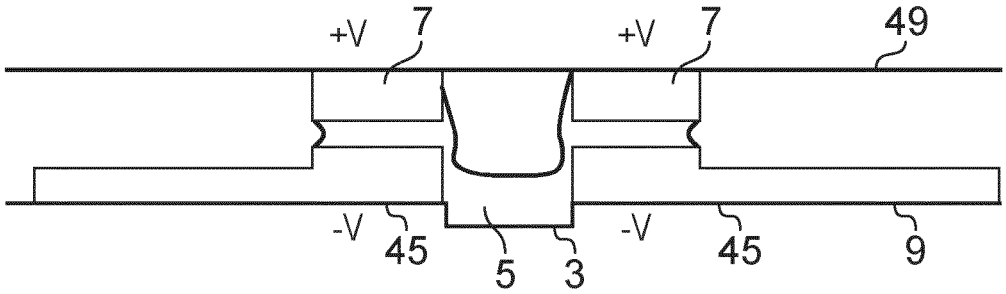
Figure 6:
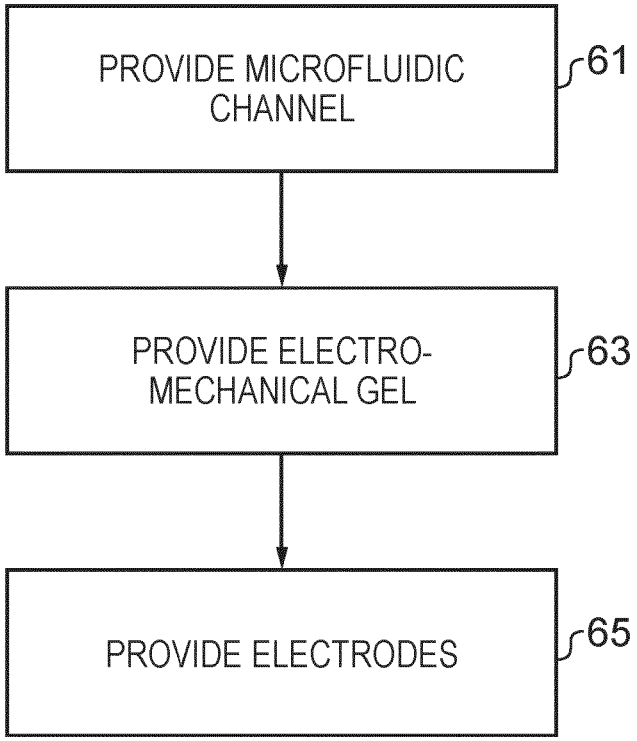
FIG. 6 illustrates a method.

The dimensions of the microfluidic channel 3 and the spacing of the pairs of electrodes 7 along the length of the microfluidic channel 3 may be selected in dependence of the volume of fluid which is to be moved. As an example the width W of the microfluidic channel 3 could be approximately 10 μm and spacing between the pairs of electrodes 7 along the length of the microfluidic channel 3 could be approximately 100 μm. The height of the microfluidic channel 3 may be the same or similar to the width of the microfluidic channel 3. This allows the open microfluidic channel 3 to be approximated as a half cylinder with radius of 5 μm. If each peristaltic pump action comprises one pair of electrodes providing a cavity 11 and an adjacent pair of electrodes 7 providing a restriction 13 then the volume of fluid moved by each pump action may be approximately 0.8 μL In some examples the apparatus 1 may comprise controlling circuitry which may be configured to control the voltages applied by the pairs of electrodes 7 across the microfluidic channel 3. FIGS. 5 and 6 illustrate example controlling circuitry apparatus which may be used.

The controlling circuitry may be configured to control the magnitude of the electric field which is applied across the microfluidic channel 3. This may enable control of the volume of fluid which is pumped through the microfluidic channel 3.

The controlling circuitry may control the sequence in which the pairs of electrodes 7 apply voltages across the microfluidic channel 3. The sequence may be controlled to enable peristaltic motion of the fluid 21 through the microfluidic channel 3.

In some examples the controlling circuitry may also control the strength of the electric field which is applied by the electrodes 7. This may control the size of the cavities 11 which are created and may be used to control the volume of fluid 21 which is moved.

It is to be appreciated that in some examples the apparatus 1 may comprise features which are not illustrated in the figures. For instance, in some examples the apparatus 1 may comprise a further substrate overlying the microfluidic channel 3. In some examples the further substrate may be transparent to enable fluid and molecules within the microfluidic channel 3 to be viewed.

Any suitable material may be used as the further substrate. In some examples the material used for the further substrate may be selected so that electromechanical gel 5 has a high affinity to the further substrate. For instance, in examples where the electromechanical gel 5 comprises polysiloxane the further substrate may comprise glass or any other suitable material. This may enable the microfluidic channel 3 to be sealed.

In some examples a film may be provided between the further substrate and the electromechanical gel 5. The film may be provided to reduce the affinity between the electromechanical gel 5 and the further substrate in the region overlaying the microfluidic channel 3. The film may comprise a polysiloxane film. The polysiloxane film may be arranged to have a higher viscosity than the electromechanical gel 5. This may prevent the polysiloxane film from deforming when the electric field is applied. The polysiloxane film may be bonded to the further substrate.

Figure 4A:
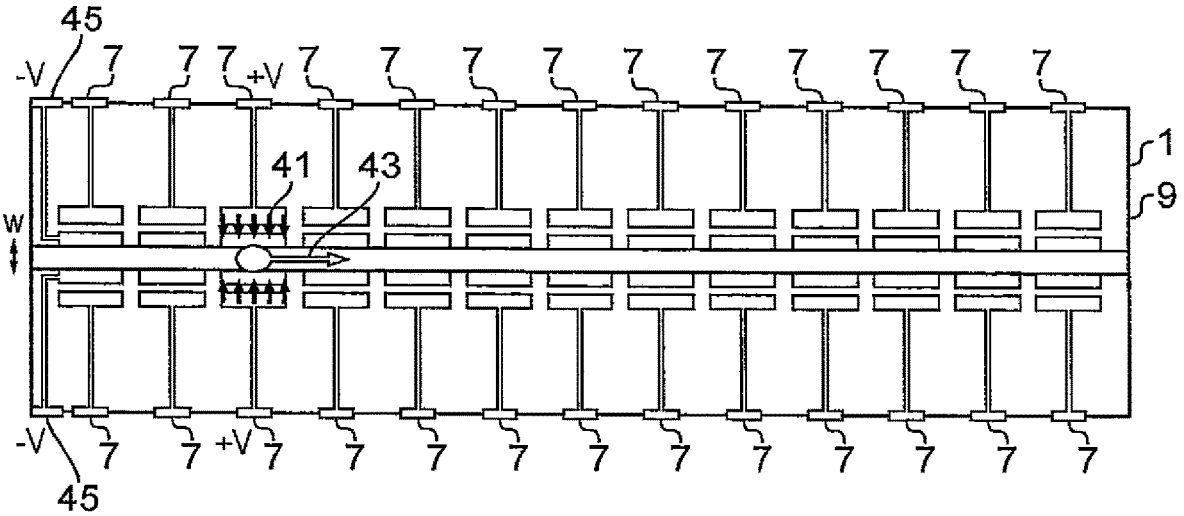
FIGS. 4A to 4C illustrate an apparatus.
Figure 4B:
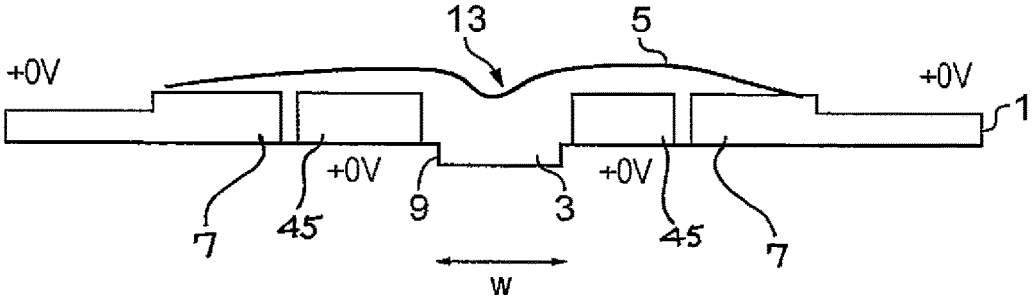
Figure 4C:
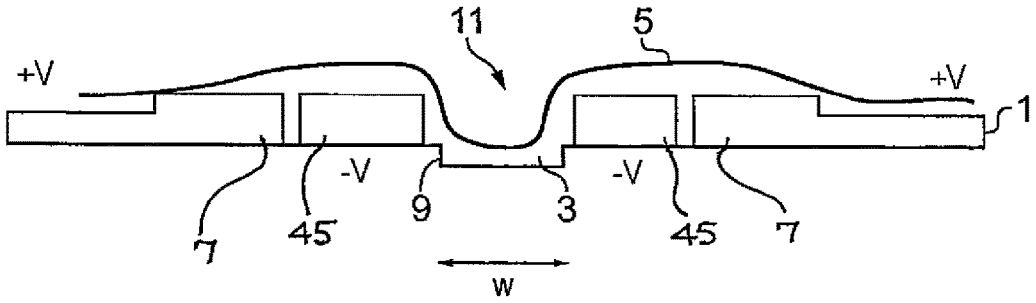

FIGS. 4A to 4C illustrate an apparatus 1 according to another example of the disclosure. The example apparatus 1 of FIGS. 4A to 4C comprise a microfluidic channel 3, an electromechanical gel 5 and at least one pair of electrodes 7.

FIG. 4A illustrates a plan view of the apparatus 1 and FIGS. 4B and 4C schematically illustrate a cross section through the apparatus 1. In the example of FIG. 4B no voltage is applied between the electrodes 7. In the example of FIG. 4C a voltage is applied between the electrodes 7.

The electromechanical gel 5 and the microfluidic channel 3 may be as described above in relation to FIGS. 1A to 3 however the plurality of pairs of electrodes 7 may be provided in a different configuration. In the example of FIGS. 4A to 4C the apparatus 1 comprises common electrodes 45 provided between the pairs of electrodes 7. In the example of FIGS. 4A to 4C two common electrodes 45 are provided. The common electrodes 45 are provided between the pairs of electrodes 7. In the examples of FIGS. 4A to 4C common electrodes 45 are provided either side of the microfluidic channel 3. The common electrodes 45 extend along the length of the microfluidic channel 3 so that the same common electrode 45 is provided between a plurality of pairs of electrodes 7.

In the example of FIG. 4A the common electrodes 45 are provided on a substrate 9 adjacent to the microfluidic channel 3. It is to be appreciated that other arrangements could be used in other examples of the disclosure. For instance, in some examples the common electrodes could form the microfluidic channel 3.

The common electrode 45 may be provided at a lower potential than the pairs of electrodes 7. The electric field within the electromechanical gel 5 may be controlled by applying a voltage to the pairs of electrodes 7.

FIGS. 4B and 4C illustrate how the electromechanical gel 5 may be deformed when the electric field across the microfluidic channel 3 is controlled.

In the example of FIG. 4B there is no voltage applied between the electrodes 7. In FIG. 4B there is no applied electric field in the electromechanical gel 5. The electromechanical gel 5 is arranged in a first configuration in which a large proportion of the electromechanical gel 5 is positioned within the microfluidic channel 3. A thick layer of the electromechanical gel 5 is provided within the microfluidic channel 3 in the first configuration so that the upper surface of the electromechanical gel 5 is separated from the surface of the microfluidic channel 3. This creates a restriction 13 within the microfluidic channel 3.

In the example of FIG. 4C a voltage is applied between the electrodes 7. In FIG. 4C there is now an applied electric field between the common electrode 45 and the electrode 7. The electric field between the common electrodes 45 and the electrode 7 is greater than the electric field within the microfluidic channel 3. This creates a region on either side of the microfluidic channel 3 which has a higher electric field than the microfluidic channel 3. This change in the effective electric field causes a change in shape of the electromechanical gel 5.

In the example of FIG. 4C the electromechanical gel 5 has deformed so that only a small proportion of the electromechanical gel 5 is positioned within the microfluidic channel 3. The layer of the electromechanical gel 5 provided within the microfluidic channel 3 is thin so that within the microfluidic channel 3 the upper surface of the electromechanical gel 5 may be close to the surface of the microfluidic channel 3. In the example of FIG. 4C the electromechanical gel 5 may deform to increase the proportion of the electromechanical gel 5 positioned between the common electrode 45 and the electrodes 7.

In the example of FIG. 4C only a small portion of the electromechanical gel 5 is provided within the microfluidic channel 3. This provides a cavity 11 within the microfluidic channel 3 which may enable fluid to be positioned within the microfluidic channel 3 and may enable fluid flow along the length of the microfluidic channel 3.

It is to be appreciated that the electrodes 7 may be controlled to sequentially apply a time varying voltage. This can be used to change the positions of cavities 11 and restrictions 13 within the microfluidic channel 3. This may enable fluid 21 to be pumped along the length of the microfluidic channel 3. In some examples the electrodes 7 may be controlled to enable fluid 21 to be pumped through the microfluidic channel 3 using a peristaltic action.

The examples of FIGS. 4A to 4C differ from the examples of FIGS. 1A to 3 in that in FIGS. 4A and 4C the restriction 13 is provided when no voltage is applied and the cavity 11 is provided when the voltage is applied. It is to be appreciated that other arrangements could be used to provide the same or similar effects. For instance, in the example of FIGS. 4A to 4C the common electrodes 45 are provided extending along the length of the microfluidic channel 3. In other examples a plurality of lower potential electrodes may be provided.

The arrangement of FIGS. 4A to 4C may reduce electrophoresis effects on the fluid 21 as it is moved along the microfluidic channel 3.

In the above described examples the electrodes 7, 45 are provided on a substrate 9. In the examples of FIGS. 1A to 4C the electrodes 7, 45 are provided on the same substrate 9 as the microfluidic channel. It is to be appreciated that other arrangements could be used in other examples of the disclosure. FIGS. 5A and 5B illustrate an apparatus 1 according to another example of the disclosure in which one or more electrodes 7 are provided on an overlaying substrate 49.

The example apparatus 1 of FIGS. 5A and 5B comprise a microfluidic channel 3, an electromechanical gel 5, at least one pair of electrodes 7 at least one common electrode 45 and an overlying substrate 49.

FIGS. 5A and 5B schematically illustrate a cross section through the apparatus 1. In the example of FIG. 5A no voltage is applied to the electrodes 7. In the example of FIG. 5B a voltage is applied to the electrodes 7.

The electromechanical gel 5 and the microfluidic channel 3 may be as described above in relation to FIGS. 1A to 4C.

The common electrodes 45 may be as described above in relation to FIGS. 4A to 4C. The common electrodes 45 may be provided on the same substrate 9 as the microfluidic channel 3. The common electrodes 45 may be provided adjacent to the microfluidic channel 3 and may extend along the length of the microfluidic channel 3. The common electrodes 45 may extend along at least a portion of the length of the microfluidic channel 3 so that the same common electrode 45 is provided between a plurality of pairs of electrodes 7.

The pairs of electrodes 7 are provided on the overlaying substrate 49. In the example of FIGS. 5A and 5B the pairs of electrodes 7 are positioned on the overlaying substrate 49 so that they are aligned with the common electrodes 7. The pairs of electrodes 7 are positioned so that they overlay at least a portion of the common electrode 45.

The overlaying substrate 49 may be made of any suitable material such as a polymer, glass, fused silica, silicon or any other suitable material. The pairs of electrodes 7 may be formed on the overlaying substrate 49 using any suitable means such as printing or deposition.

The common electrodes 45 may be provided at a lower potential than the pairs of electrodes 7. The electric field within the electromechanical gel 5 may be controlled by applying a voltage to the pairs of electrodes 7. This creates a larger electric field on either side of the microfluidic channel 3 and so controls the electric field across the microfluidic channel 3.

FIGS. 5A and 5B illustrate how the electromechanical gel 5 may be deformed when the electric field across the microfluidic channel 3 is controlled.

In the example of FIG. 5A there is no voltage applied between the electrodes 7 and the common electrodes 45. In FIG. 5A there is no applied electric field in the electromechanical gel 5. The electromechanical gel 5 is arranged in a first configuration in which a large proportion of the electromechanical gel 5 is positioned within the microfluidic channel 3 and a small proportion is provided between the common electrodes 45 and the pairs of electrodes 7. This creates a restriction 13 within the microfluidic channel 3.

In the example of FIG. 5B a voltage is applied between the electrodes 7 and the common electrodes 45. In FIG. 5B there is now an applied electric field between the common electrode 45 and the electrode 7. The electric field between the common electrodes 45 and the electrode 7 is greater than the electric field within the microfluidic channel 3. This creates a region on either side of the microfluidic channel 3 which has a higher electric field than the microfluidic channel 3. This change in the effective electric field causes a change in shape of the electromechanical gel 5.

In the example of FIG. 5B the electromechanical gel 5 has deformed so that only a small proportion of the electromechanical gel 5 is positioned within the microfluidic channel 3 and a larger proportion is provided between the common electrodes 45 and the pairs of electrodes 7. This provides a cavity 11 within the microfluidic channel 3 which may enable fluid to be positioned within the microfluidic channel 3 and may enable fluid flow along the length of the microfluidic channel 3.

A time varying voltage may be applied to the electrodes 7 to control the electric field within the microfluidic channel and control the positions of cavities 11 and restrictions 13 within the microfluidic channel 3. This may enable fluid 21 to be pumped along the length of the microfluidic channel 3. In some examples the electrodes 7 may be controlled to enable fluid 21 to be pumped through the microfluidic channel 3 using a peristaltic action.

FIG. 6 illustrates a method. The example method of FIG. 6 may be used to provide an apparatus 1 as described above. The method comprises, at block 61, providing a microfluidic channel 3 and, at block 63, providing an electromechanical gel 5 provided within the microfluidic channel 3. The method also comprises, at block 65, providing at least one pair of electrodes 7 wherein the pair of electrodes 7 is configured to control an electric field across the microfluidic channel 3. The at least one pair of electrodes 7 are configured to control the electric field across the microfluidic channel 3 to cause the electromechanical gel 5 to deform in response to a voltage applied to the electrodes 7 so that the deformation enables fluid 21 to be pumped through the microfluidic channel 3.

It is to be appreciated that the method may be performed in any suitable order. For instance in some examples the method may comprise forming a microfluidic channel 3 on a substrate 9 and then depositing electrodes 7 on the substrate 9. The electromechanical gel 5 may then be deposited over the microfluidic channel 3 and the electrodes 7.

It is to be appreciated that any suitable method may be used to provide the example apparatus 1 of the disclosure.

Figure 7:
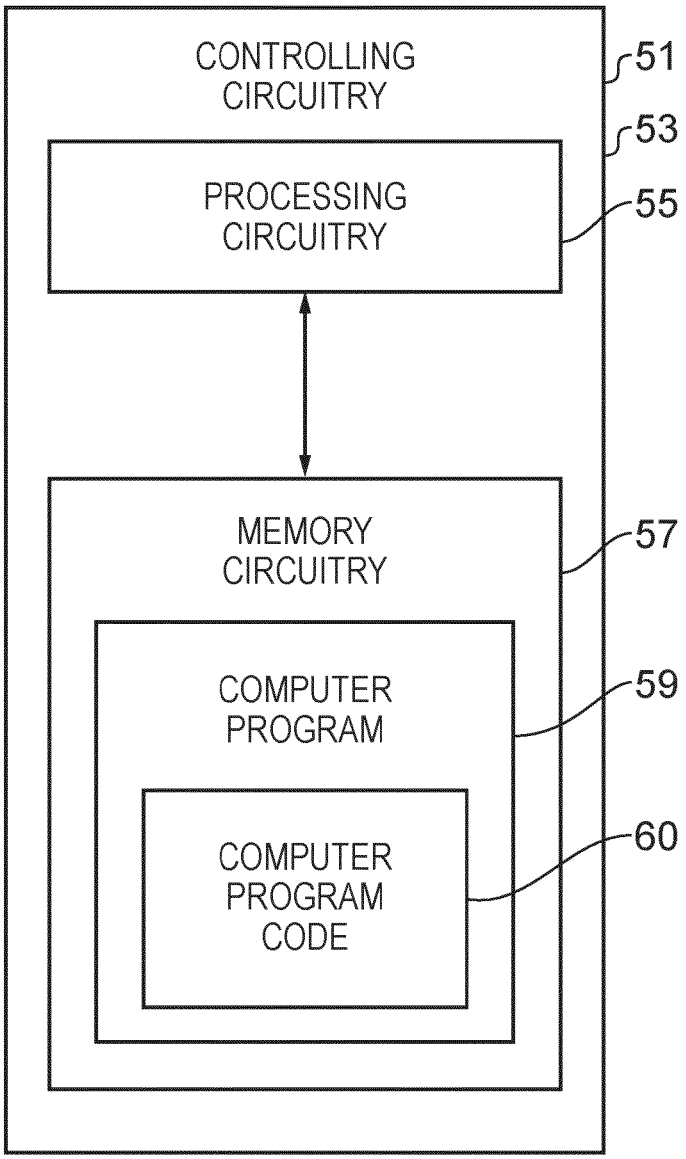
FIG. 7 illustrates an apparatus.

FIG. 7 schematically illustrates an example apparatus 51 which may be used in implementations of the disclosure. The apparatus 51 illustrated in FIG. 7 may be a chip or a chip-set. The apparatus 51 may be configured to control a microfluidic pump apparatus such as the apparatus 1 described above with regards to FIGS. 1 to 6.

The example apparatus 51 comprises controlling circuitry 53. The controlling circuitry 53 may provide means for controlling a microfluidic pump.

The controlling circuitry 53 may comprise one or more controllers. The controlling circuitry 53 may be implemented using instructions that enable hardware functionality, for example, by using executable computer program instructions in a general-purpose or special-purpose processing circuitry 55 that may be stored on a computer readable storage medium (disk, memory etc) to be executed by such processing circuitry 55.

The processing circuitry 55 may be configured to read from and write to memory circuitry 57. The processing circuitry 55 may comprise one or more processors. The processing circuitry 55 may also comprise an output interface via which data and/or commands are output by the processing circuitry 55 and an input interface via which data and/or commands are input to the processing circuitry 55.

The memory circuitry 57 may be configured to store a computer program 59 comprising computer program instructions (computer program code 60) that controls the operation of the apparatus 51 when loaded into processing circuitry 55. The computer program instructions, of the computer program 59, provide the logic and routines that enables the apparatus 51 to perform the example methods illustrated in FIG. 9. The processing circuitry 55 by reading the memory circuitry 57 is able to load and execute the computer program 59.

The apparatus 51 therefore comprises: processing circuitry; 55 and memory circuitry 57 including computer program code 60; the memory circuitry 57 and the computer program code 60 configured to, with the processing circuitry 55, cause the apparatus 51 at least to perform: controlling voltages applied by a plurality of pairs of electrodes 7 wherein the plurality of pairs of electrodes 7 are configured to provide voltages across a microfluidic channel 3 so as to deform an electromechanical gel 5 within the microfluidic channel 3 and enable fluid to be pumped through the microfluidic channel 3.

The computer program 59 may arrive at the apparatus 51 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), an article of manufacture that tangibly embodies the computer program. The delivery mechanism may be a signal configured to reliably transfer the computer program 59. The apparatus may propagate or transmit the computer program 59 as a computer data signal.

Although the memory circuitry 57 is illustrated as a single component in the figures it is to be appreciated that it may be implemented as one or more separate components some or all of which may be integrated/removable and/or may provide permanent/semi-permanent/dynamic/cached storage.

Although the processing circuitry 55 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures and sequential (Von Neumann)/parallel architectures but also specialized circuits such as field-programmable gate arrays (FPGA), application specific integrated circuits (ASIC), signal processing devices and other processing circuitry. References to computer program, instructions, code etc. should be understood to encompass software for a programmable processor or firmware such as, for example, the programmable content of a hardware device which may comprise instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Figure 8:
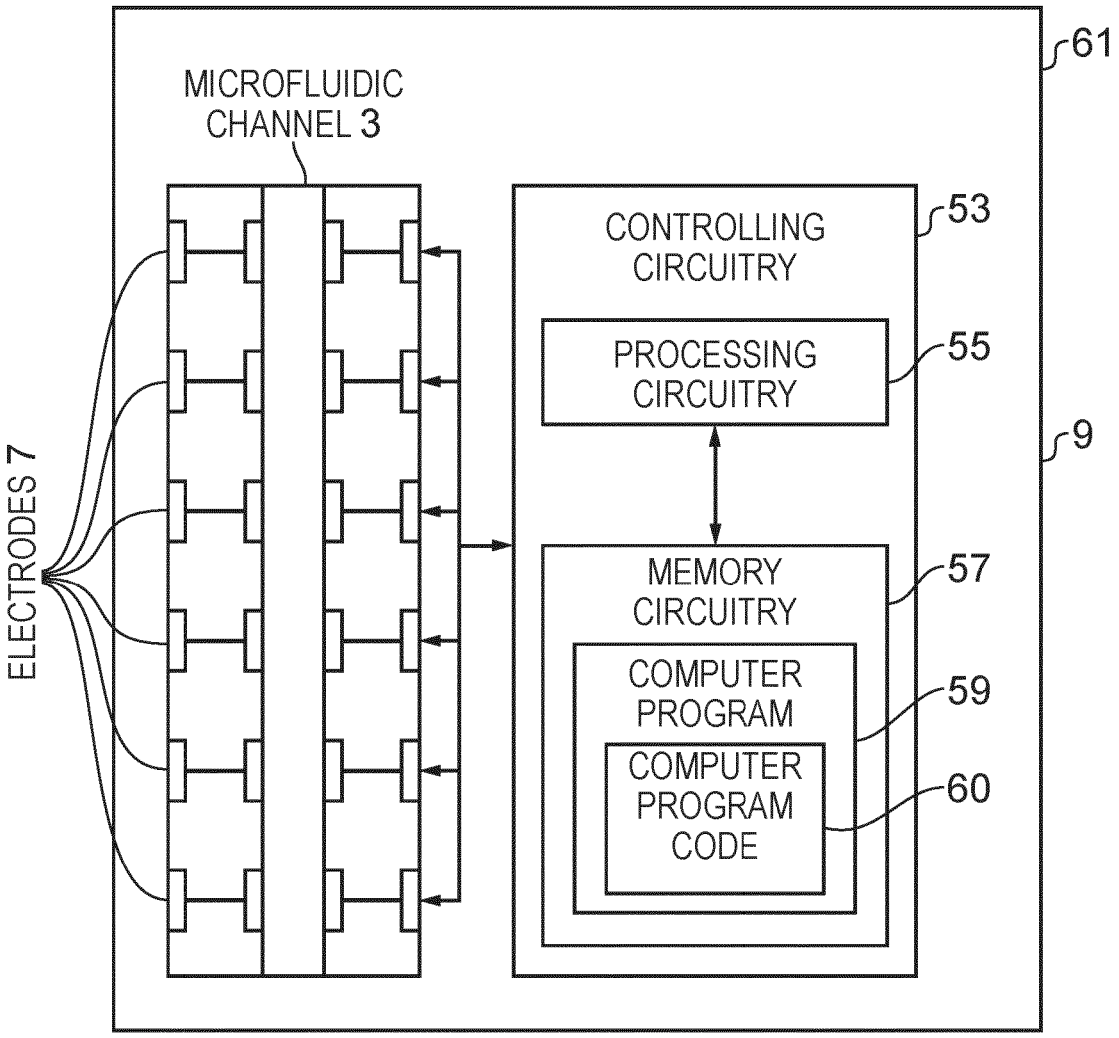
FIG. 8 illustrates an apparatus.

FIG. 8 schematically illustrates an example apparatus 61 which may comprise a chip or chip set as illustrated in FIG. 7.

The controlling circuitry 53 may be mounted on a substrate 9. A microfluidic channel 3 and plurality of electrodes 7 may also be mounted on the substrate 9. The microfluidic channel 3 and plurality of electrodes 7 may be as described above in relation to FIGS. 1A to 6. The controlling circuitry 53 may be configured to provide a control signal to the priority of pairs of electrodes 7 to control the electric fields provided by each of the pairs of electrodes 7.

In the example of FIG. 8 only one microfluidic channel 3 is illustrated. It is to be appreciated that a plurality of microfluidic channels 3 may be provided in a single apparatus 61. This may enable larger volumes of fluid 21 to be controlled or may be used to enable different types of fluid 21 to be controlled.

Figure 9:
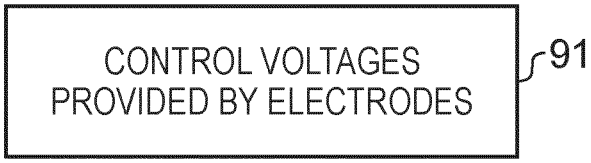
FIG. 9 illustrates a method.

FIG. 9 illustrates a method. The method of FIG. 9 may be performed by apparatus 51, 61 such as the apparatus of FIGS. 7 and 8. The method comprises, at block 71 controlling voltages applied by a plurality of pairs of electrodes 7 wherein the plurality of pairs of electrodes 7 are configured to control an electric field across a microfluidic channel 3 so as to deform an electromechanical gel 5 within the microfluidic channel 3 and enable fluid to be pumped through the microfluidic channel 3.

The blocks illustrated in FIGS. 6 and 9 may represent steps in a method and/or sections of code in the computer program 59. The illustration of a particular order to the blocks does not necessarily imply that there is a required or preferred order for the blocks and the order and arrangement of the block may be varied. Furthermore, it may be possible for some blocks to be omitted.

The example methods and apparatus 1, 51, 61 described above provide the advantage that a microfluidic pump can be fabricated on a single apparatus. The microfluidic pump can be created without any micro-electromechanical systems which may make the apparatus 1 simpler and more cost effective to manufacture.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this detailed description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed. For instance in the above described examples the apparatus 1 is configured to act as a pump. In other examples the apparatus 1 could act as a stop or valve or any other suitable device.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a substrate, said substrate having a microfluidic channel formed thereon;

an electromechanical gel provided within the microfluidic channel;

at least one pair of electrodes arranged on the substrate on opposite sides of the microfluidic channel wherein the pair of electrodes is configured to control an electric field across the microfluidic channel; and a common electrode of lower potential than the at least one pair of electrodes, said common electrode being arranged between the at least one pair of electrodes, wherein the at least one pair of electrodes axe is configured to control the electric field across the microfluidic channel to cause the electromechanical gel to deform in response to a voltage applied to the electrodes such that the deformation enables fluid to be pumped through the microfluidic channel.

2. The apparatus as claimed in claim 1, wherein the at least one pair of electrodes is configured to enable the voltage to be provided perpendicular to a direction of fluid flow within the microfluidic channel.

3. The apparatus as claimed in claim 1, wherein the at least one pair of electrodes is configured to provide a voltage across the microfluidic channel.

4. The apparatus as claimed in claim 1, wherein the at least one pair of electrodes is configured to provide a voltage close to the microfluidic channel.

5. The apparatus as claimed in claim 1, wherein the apparatus comprises a plurality of pairs of electrodes.

6. The apparatus as claimed in claim 5, wherein the plurality of pairs of electrodes extend parallel to a direction of fluid flow within the microfluidic channel.

7. The apparatus as claimed in claim 5, wherein the plurality of pairs of electrodes are configured to sequentially apply a voltage across the microfluidic channel.

8. The apparatus as claimed in claim 7, wherein the sequentially applied voltages enable peristaltic pump action through the microfluidic channel.

9. The apparatus as claimed in claim 1, wherein the at least one pair of electrodes is configured so that the electromechanical gel deforms to form a cavity within the microfluidic channel when a voltage is applied to the electrodes.

10. The apparatus as claimed in claim 1, wherein the at least one pair of electrodes is configured so that the electromechanical gel deforms to form a restriction within the microfluidic channel when a voltage is applied to the electrodes.

11. The apparatus as claimed in claim 1, further comprising:

controlling circuitry configured to control the voltages applied by the at least one pair of electrodes across the microfluidic channel.

12. The apparatus as claimed in claim 1, further comprising a second substrate overlying the microfluidic channel.

13. The apparatus as claimed in claim 12, further comprising a film between the second substrate and the electromechanical gel wherein the film has a higher viscosity than the electromechanical gel.

14. A method comprising:

providing a substrate, said substrate having a microfluidic channel formed thereon;

providing an electromechanical gel within the microfluidic channel;

providing at least one pair of electrodes arranged on the substrate on opposite sides of the microfluidic channel wherein the pair of electrodes is configured to control an electric field across the microfluidic channel; and providing a common electrode of lower potential than the at least one pair of electrodes, said common electrode being arranged between the at least one pair of electrodes, wherein the at least one pair of electrodes is configured to control the electric field across the microfluidic channel to cause the electromechanical gel to deform in response to a voltage applied to the electrodes such that the deformation enables fluid to be pumped through the microfluidic channel.

15. The method as claimed in claim 14 wherein the at least one pair of electrodes is configured to enable the voltage to be provided perpendicular to a direction of fluid flow within the microfluidic channel.

* * * * *